United States Patent [19]

Priebe

[11] Patent Number: 4,548,525

[45] Date of Patent: Oct. 22, 1985

[54] METHOD AND APPARATUS FOR PRE-DILUTION OF DRILLING MUD SLURRY AND THE LIKE

[75] Inventor: William F. Priebe, Carrollton, Tex.

[73] Assignee: Atlantic Richfield Company, Los Angeles, Calif.

[21] Appl. No.: 449,020

[22] Filed: Dec. 13, 1982

[51] Int. Cl.[4] ..... E02B 13/00; E21B 21/06; B63H 1/06

[52] U.S. Cl. ..... 405/52; 175/7; 175/66; 175/207; 417/151

[58] Field of Search ..... 405/52, 60, 74, 77, 405/80, 127; 175/7, 66, 206, 207; 210/170, 747; 239/432, 433, 434.5; 417/151, 167, 194

[56] References Cited

U.S. PATENT DOCUMENTS

| | | | |
|---|---|---|---|
| 1,137,767 | 5/1915 | Leblanc | 417/197 X |
| 1,500,012 | 7/1924 | Staples | 239/432 X |
| 1,778,194 | 10/1930 | Kreager | 239/432 X |
| 2,044,088 | 6/1936 | Lord | 417/151 |
| 2,293,632 | 8/1942 | Sauer | 417/194 X |
| 2,479,783 | 8/1949 | Sawyer et al. | 417/151 X |
| 2,552,644 | 5/1951 | Ofeldt | 239/433 |
| 2,705,620 | 4/1955 | Borck | 417/151 X |
| 2,931,580 | 4/1960 | Johnson | 239/433 X |
| 3,693,733 | 9/1972 | Teague | 175/66 |
| 4,175,039 | 11/1979 | Fisher | 175/66 X |
| 4,220,207 | 9/1980 | Allen | 175/7 X |
| 4,264,212 | 4/1981 | Tookey | 417/151 X |
| 4,439,069 | 3/1984 | Kelly, Jr. et al. | 175/66 X |

FOREIGN PATENT DOCUMENTS

| | | | |
|---|---|---|---|
| 1584977 | 1/1972 | Fed. Rep. of Germany | 210/170 |
| 8000223 | 7/1980 | Netherlands | 239/433 |
| 626192 | 9/1978 | U.S.S.R. | 175/66 |

*Primary Examiner*—Cornelius J. Husar
*Assistant Examiner*—Nancy J. Stodola
*Attorney, Agent, or Firm*—Robert M. Betz

[57] ABSTRACT

An aqueous slurry of spent drilling mud and/or produced water is diluted prior to free discharge into a body of receiving water by expelling a jet stream of such slurry into an open-ended submerged mixing conduit. The jet stream aspirates and entrains the surrounding water within the conduit and is then passed through a mixer stage prior to exiting the opposite end of the tube.

17 Claims, 3 Drawing Figures

METHOD AND APPARATUS FOR PRE-DILUTION OF DRILLING MUD SLURRY AND THE LIKE

BACKGROUND OF THE INVENTION

1. Field of the Invention

This invention relates generally to the art of jet mixing and more particularly to a method and apparatus for pre-dilution of a fluid prior to discharge into a receiving body of water.

2. Prior Art

In offshore drilling it is necessary to dispose of spent or discarded drill mud and cuttings and/or produced water. Normally such spent muds and cuttings are discharged into the receiving waters. Pre-dilution may be required to prevent the discharge of a concentrated mud plume which tends to settle, since its specific gravity may be as much as two and a half times that of water. It is further theorized that when the mud settles to the bottom it forms a mound which smothers certain marine organisms. In addition, the mud or produced water is theorized to contain certain pollutants which the toxicity of is concentration dependent.

Commonly, pre-dilution if required is accomplished by pumping water into the spent mud or produced water stream from the drilling rig prior to discharge. Where only low discharge rates are allowed the existing fire water system for the rig can be modified to accomplish dilution with minimal capital investment. In cases where higher discharge rates are allowed, the fire water system may prove inadequate and a separate dedicated dilution pump and piping system may have to be installed. It is of course desirable that heavy, spent mud be discharged as rapidly as possible in order to facilitate movement of the drilling rig, since delays in these operations can be very costly.

Recent actions by regulatory agencies have placed pre-dilution requirements on the discharge of spent drill muds and cuttings into receiving waters. Certain discharge permits contain a provision requiring that the drill muds and cuttings be diluted in the ratio of at least 9:1 with the receiving water prior to discharge. A similar requirement is considered possible in the future for produced water.

The invention to be described utilizes a process known as jet mixing wherein one liquid is pumped through a small orifice into a flowing stream of another. Jet mixing is used, for example, in the chemical industry for liquid-liquid extraction. However, in the present invention jet mixing is used to dilute a fluid jet stream in a desired volume ratio with the entrained liquid rather than for dispersion of the jet stream into finely-divided droplets of any particular dimensions. The invention also utilizes the technique of aspiration, wherein the flow of one liquid (the aspirated liquid) is induced by the flow of another (the receiving liquid) at higher velocity. Contrary to common practice however, in the present invention, a larger stream is sucked into a smaller stream rather than vice versa.

It is therefore a general object of this invention to provide an improved method and apparatus for pre-dilution of a fluid such as drill mud and the like prior to free discharge into a receiving body of water.

It is a more particular object of this invention to provide a method and apparatus for pre-dilution of such fluids which is energy efficient and essentially unlimited in capacity.

It is a still further object of this invention to provide such a method and apparatus wherein discharge of a fluid stream into a receiving body of water may be constantly aligned with the current direction in said body of water.

It is yet a further object of this invention to provide a method and apparatus for pre-dilution of a fluid prior to discharge into a receiving body of water without utilizing any moving parts.

Other objects and advantages of this invention will become apparent from a consideration of the detailed description to follow, taken in conjunction with the drawings and claims appended thereto.

SUMMARY OF THE INVENTION

In accordance with the preferred embodiment of this invention a fluid such as drill mud slurry or produced water is expelled into one end of an open-ended conduit supported in a submerged position so that the fluid forms an expanding jet stream within the conduit. As the jet stream moves through the conduit, it aspirates and entrains a quantity of the surrounding water whereby the fluid is diluted prior to exiting from the opposite end. Blade means are interposed within the pipe in the path of the fluid stream to produce turbulence and mixing of the fluid to a more uniform consistency. Means may be provided for continuous alignment of the conduit with the existing current in the body of receiving water. Additionally, the conduit may be slanted downwardly with respect to the horizontal to compensate for the downwardly skewing effect on the fluid jet stream of the force of gravity. The invention comprehends both the apparatus described above and the method carried out thereby.

A BRIEF DESCRIPTION OF THE DRAWINGS

DETAILED DESCRIPTION OF THE PREFERRED EMBODIMENT

Figure 1:
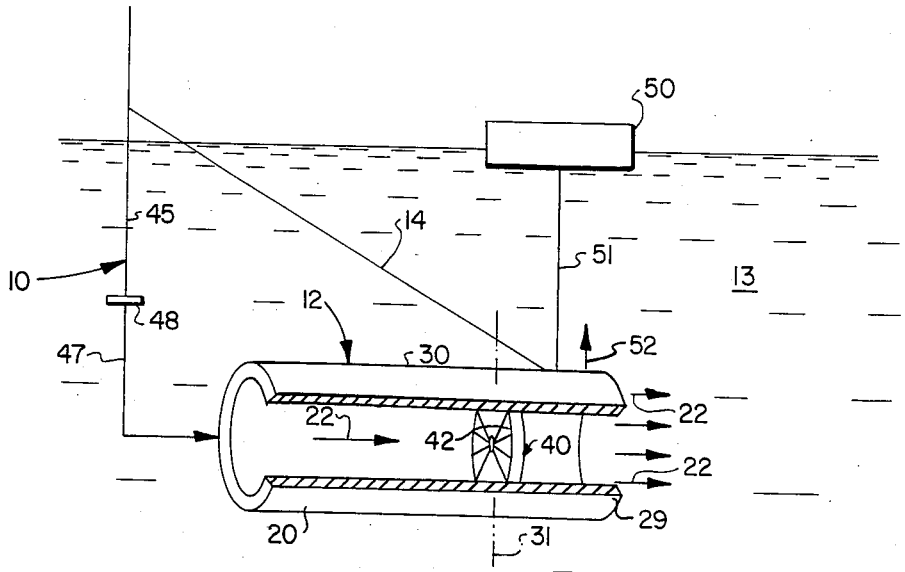
FIG. 1 is a diagramatic view of apparatus with conduit 12 shown partially cut away to reveal its interior in accordance with the preferred embodiment of this invention.

Referring now to FIG. 1, apparatus for the practice of this invention includes a slurry transfer line 10 through which mud slurry, produced water, or the like may be conveyed into an open-ended tubular mixing conduit 12 such as, for example, a length of circular pipe supported in a generally horizontal submerged state within a body of receiving water 13 with the aid of supporting guy wire 14, which is secured in a suitable fashion to transfer line 10.

Figure 2:
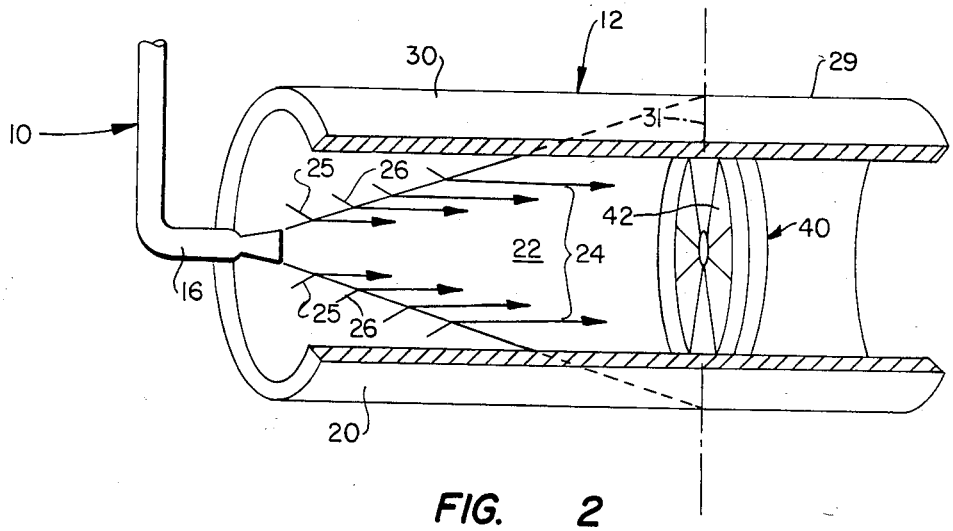
FIG. 2 is a partially diagramatic enlarged view of a mixing conduit shown partially cut away to reveal its interior in combination with a slurry-transfer line in accordance with the embodiment of FIG. 1.

As best seen in FIG. 2 transfer line 10 may be terminated at its downward end in a jet nozzle 16 projecting in a generally horizontal direction inwardly of open-end 20 of conduit 12. By suitable means (not shown) such as radial spokes, nozzle 16 may be centered within and directed along the longitudinal axis of conduit 12. Responsive to the pressure head existing at nozzle 16, which is dependent upon the vertical extent of transfer line 10, slurry is expelled through nozzle 16 in the form of an expanding jet 22 whose profile boundary 24 interfaces with the surrounding water. By suction effect, the slurry aspirates receiving water into conduit 12 through the annular space between nozzle 16 and longitudinal conduit wall 30 where it is entrained across boundary 24 by the expanding jet 22 such as along paths 25 and 26. The slurry is thus dispersed and diluted. As jet 22, including water entrained therein, travels the length of conduit 12 it is also thoroughly mixed after which the diluted slurry exits the opposite end 29 and freely discharges into body of water 13.

The dilution achieved in the manner described continues until the boundary 24 of jet stream 22 contacts the longitudinal wall 30 of conduit 12 at some intermediate longitudinal stage 31 after which the stream 22 undergoes turbulent mixing until it reaches end 29. As stream 22 expands it becomes more dilute at boundary 24 and progressively less so toward its interior. The length of conduit 12 between stage 31 and end 29 permits the fluid in the stream 22 to reach a more homogeneous consistency prior to free discharge.

Figure 3:
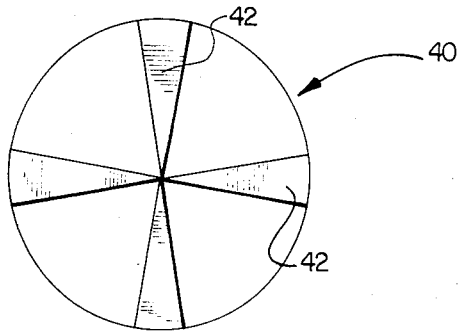
FIG. 3 illustrates diagramatically a static mechanical mixer for insertion within the mixing conduit shown in FIGS. 1 and 2.

In order to enhance the process of mixing the diluted jet stream 22, a mixer 40 may be inserted within conduit 12. Mixer 40, as shown diagramatically in FIG. 3, may consist of a plurality of radial blades 42 extending generally transversely to the longitudinal axis of and within conduit 12 and oriented so as to impart a rotary motion to the jet stream 22. The blades 42 may be either fixed or rotatable. Many other mixer designs and modes of operation may be substituted for mixer 40 within the scope of this invention. Mixer 40 is placed preferably at stage 31 so as not to interfere with the dilution process and to utilize the remaining length of conduit 12 to best advantage. Inserting a static mixer 40 improves the mixing efficiency of the apparatus but reduces the degree of dilution in jet stream 22. This may be overcome by increasing the velocity of stream 22 or enlarging the cross-sectional area of conduit 12. If, on the other hand, a dynamic mixer is employed, it acts like a pump and significantly increases the maximum dilution potential of the device. If the mud slurry in jet stream 22 is denser than the receiving water 13, which is generally the case in drill muds, conduit 12 should have a downward orientation to account for the acceleration of gravity. If the mixing boundary 24 prematurely impinges on the bottom of conduit wall 30, the amount of achievable dilution will be reduced for a given jet velocity and mixing conduit design. Conduit 12 must also have adequate slope to prevent settling and accumulation of dense components over the slurry in stream 22.

In order to take advantage of any existing current in body of water 13 it is desirable to align conduit 12 with the direction of such current since an aiding current will increase the dilution achievable. For this purpose transfer line 10 may be composed of a fixed straight upper section 45 and a lower elbow section 47 operatively interconnected to upper section 47 through a suitable swivel joint or mechanism 48 to enable rotation of section 47 about its own vertical axis. This permits an operator to directionally adjust the orientation of conduit 12 for alignment with the current. A buoy 50 may be attached by means of cable 51 to conduit 12 adjacent end 29 so as to support conduit 12 and automatically orient it in alignment with the receiving water current. Buoy 50 also marks the position of conduit 12 and guy 14 so they won't be damaged by movement of surface craft associated with drilling operations.

It is clear that the design of the mixing chamber exemplified by conduit 12 involves consideration of a number of interdependent factors, some of which have already been discussed, the ultimate objective being to achieve adequate dilution and homogeneous mixing in the shortest chamber length. Additional factors are discussed hereafter.

For example, in theory there is no upper boundary to the area of conduit 12. However, mixing effects due to the interaction of the jet stream 22 and the wall 30 plus cost make construction of the minimum cross-sectional area consistent with the dilution required a desirable objective.

Additional chamber length may be required if the chamber is oriented vertically without a mixer and the slurry is denser than the receiving water. The difference in density will impart downward acceleration to the jet and to the dilution water not present in a horizontal chamber. The result of the acceleration component can be to cause the dilution jet to exit the chamber before complete mixing occurs. Thus, increased chamber length may be required to prevent the exit of stratified flow.

Consideration must also be given to making the chamber long enough to prevent recirculation of the diluted slurry. Although not normally a problem because of the settling effects of drill muds and cuttings and the mass-transfer tendency of currents, in static (current free) conditions, neutral buoyancy slurry such as produced waters may have a tendency to migrate to the intake side of the chamber particularly if dynamic mixing is used. Adequate chamber length can alleviate this problem.

Once the mixing cell exemplified by conduit 12 is designed and installed the dilution can be altered by changing lateral conduit orientation to the receiving water current or by changing the flow rate of jet stream 22 in bbl/hr. or its velocity in ft/sec.

It may be desirable to sample the chamber discharge to determine if adequate dilution has occurred. For example, a nozzle 52 can be inserted in conduit 12 adjacent end 29 and interconnected with a tube attached to a surface pump (not shown). The pump can then be run continuously or intermittently to draw from the chamber and the pump discharge can be sampled.

Following is an example of mixing chamber design in accordance with the teachings of this invention, based on hypothetical assumptions, utilizing reasonable overdesign factors and skill of the art engineering calculations:

Independent parameters:

1. Dilution ratio=9:1
2. Slurry specific gravity=2.5
3. Ht. of transfer line above receiving water surface=70 ft.
4. Undiluted slurry flow rate (max.)=300 bbl/hr.
5. Diameter of transfer line nozzle, without constriction=3 in.
6. Mixer=static
7. Conduit=circular, vertical orientation Dependent parameters:

1. length of conduit=20 ft.
2. Slurry velocity=9.12 ft/sec.
3. Conduit diameter=24"
4. Miller distance from conduit inlet=14"
5. Miller blades contruction=45° to conduit axis, 40% of projected conduit area What has been described and shown is illustrative only of an apparatus for practicing this invention and many modifications of the features thereof will occur to those skilled in this art without departing from the scope of this invention as more particularly set forth in the claims.

What is claimed is:

1. Apparatus for pre-dilution of a fluid prior to free discharge thereof into a receiving body of water comprising:

(a) an open-ended conduit;

(b) means for positioning said conduit so that both ends thereof lie completely submerged beneath the surface of said body of water;

(c) a fluid line for delivering a stream of said fluid under pressure to within one end of said conduit;

(d) a nozzle terminating said fluid line within said one end for expelling said fluid stream in the form of an expanding fluid jet directed along the longitudinal axis of said conduit toward the opposite end thereof, said fluid line and nozzle being so located with respect to the wall of said conduit as to leave a generally annular space therebetween to thereby cause entrainment in said fluid jet of a quantity of the surrounding water.

2. Apparatus as in claim 1 including means within said conduit for mixing said fluid jet to a more uniform consistency.

3. Apparatus as in claim 2 wherein said mixing means comprises a plurality of blades interposed in the path of said fluid jet for imparting turbulent motion thereto.

4. Apparatus as in claim 3 wherein said blade means are fixed.

5. Apparatus as in claim 3 wherein said blade means are rotatable and further including a power source for providing rotation to said blade means.

6. Apparatus as in claim 1 wherein means are provided for aligning said conduit with the current direction in said body of water.

7. Apparatus as in claim 1 including means for orienting the longitudinal axis of said conduit so as to slant downwardly from said one end of said opposite end at a selected angle to the horizontal.

8. Apparatus as in claim 1 including means for supporting said conduit so that it extends in a vertical direction.

9. Apparatus as in claim 1 wherein said fluid is a drilling mud slurry.

10. Apparatus as in claim 1 wherein said fluid is a produced water.

11. A method for pre-dilution of a fluid to be discharged into a body of water comprising the steps of:

(a) supporting an open-ended conduit so that both ends are completely submerged beneath the surface of said body of water;

(b) delivering a stream of said fluid under pressure to within one end of said conduit, said stream being so located with respect to the wall of said conduit so as to leave a generally annular space therebetween; and (c) converting said stream into an expanding fluid jet adapted to traverse said conduit and exit the opposite end thereof, said jet being diluted by entrainment of water aspirated from said body of water through said annular space into said one end of said conduit.

12. A method as in claim 11 including the step of continuously aligning said conduit with the direction of current flow in said body of water.

13. The method of claim 10 including the step of slanting the longitudinal axis of said conduit downwardly in respect to the horizontal from said one end of said opposite end.

14. The method of claim 11 including the step of supporting said conduit so that it extends in a vertical direction.

15. The method of claim 11 including the step of imparting turbulence to said diluted fluid jet stream within said conduit prior to its exit from said opposite end thereof.

16. The method of claim 11 wherein said fluid is a drilling mud slurry.

17. The method of claim 11 wherein said fluid is a produced water.

* * * * *